US011401154B2

(12) United States Patent
Huijsmans-Steenkamp et al.

(10) Patent No.: US 11,401,154 B2
(45) Date of Patent: Aug. 2, 2022

(54) SYSTEM FOR TRANSFERRING CRUDE OIL FROM AN ONSHORE LOCATION TO A VESSEL

(71) Applicant: BLUEWATER ENERGY SERVICES B.V., Hoofddorp (NL)

(72) Inventors: Ellis Marion Huijsmans-Steenkamp, Hoofddorp (NL); Roland Wilhelmus van der Zande, Hillegom (NL)

(73) Assignee: BLUEWATER ENERGY SERVICES B.V., Hoofddorp (NL)

( * ) Notice: Subject to any disclaimer, the term of this patent is extended or adjusted under 35 U.S.C. 154(b) by 434 days.

(21) Appl. No.: 16/699,541

(22) Filed: Nov. 29, 2019

(65) Prior Publication Data

US 2021/0163278 A1 Jun. 3, 2021

(51) Int. Cl.

| | |
|---|---|
| ***B67D 9/00*** | (2010.01) |
| ***B63B 27/34*** | (2006.01) |
| ***B63B 35/00*** | (2020.01) |
| ***B63B 22/00*** | (2006.01) |
| ***B63B 27/25*** | (2006.01) |

(52) U.S. Cl.

CPC ..... *B67D 9/00* (2013.01); *B63B 22/00* (2013.01); *B63B 27/25* (2013.01); *B63B 27/34* (2013.01); *B63B 35/003* (2013.01)

(58) Field of Classification Search

CPC ..... B67D 9/00; B63B 22/00; B63B 27/25; B63B 27/34; B63B 35/003

See application file for complete search history.

(56) References Cited

U.S. PATENT DOCUMENTS

| | | | | |
|---|---|---|---|---|
| 2019/0359294 | A1* | 11/2019 | Sullivan | B63B 27/34 |
| 2019/0360319 | A1* | 11/2019 | Samuelsberg | E21B 43/01 |
| 2020/0156926 | A1* | 5/2020 | Bishop | G05D 7/0676 |

* cited by examiner

*Primary Examiner* — Jason K Niesz

(74) *Attorney, Agent, or Firm* — Steven M. Koehler; Westman, Champlin & Koehler, P.A.

(57) ABSTRACT

A system for transferring crude oil from an onshore location to an offshore vessel comprises a buoy, a floating vapor hose supported by the buoy and configured to be connected to the vessel for discharging vapor; a subsea pipe-line end manifold (PLEM); a subsea vapor hose extending between the PLEM and the buoy, and connected via the buoy internal piping to the floating vapor hose; a subsea vapor line extending between a vapor processing facility and the PLEM and connected to the subsea vapor hose; wherein the system further comprises a drain for the removal of condensed vapor from at least one of the floating vapor hose, subsea vapor hose and subsea vapor pipeline.

21 Claims, 4 Drawing Sheets

SYSTEM FOR TRANSFERRING CRUDE OIL FROM AN ONSHORE LOCATION TO A VESSEL

BACKGROUND

The discussion below is merely provided for general back-ground information and is not intended to be used as an aid in determining the scope of the claimed subject matter.

The invention relates to a system for vapor control while transferring crude oil from an onshore location to a vessel or tanker (such as crude carriers/oil tankers) located offshore and moored to a buoy. The purpose of the system is to load such vessels. During loading the vessel with the crude oil, vapor within the vessels cargo tanks is pushed out. This vapor can be discharged directly to the environment through cargo tank vent valves, but nowadays there is an increasing demand for systems in which the vapor pushed out is directed to a vapor processing facility at which the vapor in some manner is environmentally friendly processed (or re-used, for example as blanketing gas in an onshore storage facility).

In such a system the vapor will be fed through hoses and pipelines of a vapor return system. However, in the vapor stream through the hoses and pipelines liquid may drop out of the vapor, for example due to changing conditions such as cooling down and condensation of the vapor. This vapor drop out can be substantial and may cause a blockage in the vapor return system.

SUMMARY

This Summary and Abstract are provided herein to introduce a selection of concepts in simplified form that are further described below in the Detailed Description. The Summary and Abstract are not intended to identify key features or essential features of the claimed subject matter, nor are they intended to be used as an aid in determining the scope of the claimed subject matter. The claimed subject matter is not limited to the implementations that solve any or all of the disadvantages noted in the background.

An aspect of the present invention is a system for transferring crude oil from an onshore location to an offshore vessel comprising:

a buoy provided with buoy piping;

at least one floating oil hose having a first end supported by the buoy and an opposite second end configured to be connected to the vessel;

at least one floating vapor hose having a first end connected to the buoy piping and an opposite second end configured to be connected to the vessel;

at least one subsea pipe-line end manifold (PLEM);

at least one subsea oil hose having a first end supported by the PLEM and an opposite end connected to the buoy piping;

at least one subsea oil pipeline having a first end configured to be connected to an onshore oil supply and a second end supported by the PLEM and, directly or indirectly, connected to the first end of the at least one subsea oil hose;

at least one subsea vapor hose having a first end supported by the PLEM and an opposite second end connected to the buoy piping;

at least one subsea vapor pipeline having a first end configured to be connected to a vapor processing facility and a second end supported by the PLEM and, directly or indirectly, connected to the first end of the at least one subsea vapor hose;

wherein the system further comprises means for the removal of condensed vapor from at least one of the floating vapor hose, buoy piping, subsea vapor hose and subsea vapor pipeline.

It is noted that although the term 'condensed vapor' is used, this should be interpreted throughout this application as any liquid drop out from the vapor, also if not resulting from condensation.

Using the drain, condensed vapor that accumulates in any of the vapor hoses and vapor pipeline may be removed, thus preventing that such accumulated vapor will block any of these vapor hoses and vapor pipeline and thus will prevent the system from functioning in a correct manner.

In one embodiment the floating vapor hose in the region of its first end defines a collecting hose part located at a lower level than opposite adjoining parts of the floating vapor hose and wherein a drain is provided for draining condensed vapor which has collected at said collecting hose part. As a result of being located at said lower level the collecting hose part effectively collects any liquid drop out, which then can be drained therefrom.

In another embodiment the drain comprise an access port offering access to an interior of the floating vapor hose, and preferably a draining tube is provided extending from the access port into the floating vapor hose and ending at said collecting hose part. Using the draining tube any condensed vapor may be removed effectively through the access port. It is noted that 'offering access' in this context does not necessarily require that the access port is provided in the floating vapor hose.

In one embodiment the draining tube is configured to be removed from the floating vapor hose. In such an embodiment the draining tube only will be present in the floating vapor hose during a draining operation. Thereafter it can be removed for offering an unobstructed flow of the vapor through the hose.

A suction generator may be provided and configured to be connected to the draining tube for actively draining condensed vapor from the collecting hose part. Without such suction, in alternative embodiments the draining of the condensed vapor may occur by gravity.

In another embodiment the access port is configured to be converted between an open and a closed position. The closed position generally will be the position in which a vapor flow occurs, whereas the open position then will be used for draining.

For example, in such an embodiment, the access port is provided with a manually operable closure member.

In one embodiment the access port is provided in the buoy piping. Such a buoy piping generally will be a fixed part of the buoy.

It also is possible that the access port is provided at the collecting hose part and that an external draining tube connects to the access port.

In another embodiment the system is provided with two subsea vapor pipelines each having a first end configured to be connected to the vapor processing facility and a second end supported by the PLEM and, directly or indirectly, connected to the first end of the at least one subsea vapor hose, wherein a collecting line loop is provided having opposite ends which are connected to respective ones of the two subsea vapor pipelines and which collecting line loop has a central part located at a lower level than its opposite ends and wherein a drain is provided for draining condensed vapor which has collected at said central part of the collecting line loop.

In such an embodiment the condensed vapor (or liquid drop out) is collected and removed at the PLEM.

In one embodiment the central part of the collecting line loop defines the lowermost part of the assembly of subsea vapor hose, subsea vapor pipelines and collecting line loop. As a result it is effectively assured that the condensed vapor collects at the collecting line loop and thus does not obstruct the vapor flow through any of these parts.

In another embodiment the collecting line loop is located at and is supported by the PLEM. This assures a stable position of the collecting line loop.

In yet another embodiment the PLEM is provided with two vapor line T-connectors each comprising first and second ports located in line with each other, of which the first ports respectively are connected to the second ends of the subsea vapor pipelines and of which the second ports respectively are connected to the opposite ends of the collecting line loop, and wherein each vapor line T-connector further comprises a third port at an angle with the first and second ports, wherein each third port is connected to the first end of the at least one subsea vapor hose.

In such an embodiment it is possible that a pigging system is provided comprising a pig which is movable through the collecting line loop for removing condensed vapor which has collected at the central part of the collecting line loop. Such a pigging system further may be provided with a pig launching station (or pig launcher) for introducing the pig into the subsea vapor pipeline and a pig receiving station (or pig catcher) for removing the pig, as is commonly known in the field of pigging as 'round-trip pigging'.

When the first and second ports define a circumferential inner surface and the third port has an opening which is provided with bars defining an inner guiding surface for the pig contiguous with said inner surface, a smooth passage of the pig through the T-connectors may be assured.

In another embodiment the third ports or the vapor hoses connecting thereto are configured to be closed by closure members, such as valves. This enables to temporarily stop the vapor flow when a pigging operation is carried out.

The system further may be provided with a second subsea pipe-line end manifold (second PLEM), wherein the system further comprises a subsea oil hose having a first end supported by the second PLEM and an opposite second end supported by the buoy and, directly or indirectly, connected to the first end of the floating oil hose, wherein the subsea oil pipeline comprises a first end configured to be connected to the onshore oil supply and a second end supported by the second PLEM and, directly or indirectly, connected to the first end of the subsea oil hose.

In such a case the PLEM and the second PLEM may be integrated into a single combined PLEM.

In one embodiment of the system the floating vapor hose in the region of its first end defines a collecting hose part located at a lower level than opposite adjoining parts of the floating vapor hose and wherein a first drain is provided for draining condensed vapor which has collected at said collecting hose part, and wherein the system further is provided with two subsea vapor pipelines having a first end configured to be connected to the vapor processing facility and a second end supported by the PLEM and, directly or indirectly, connected to the first end of the at least one subsea vapor hose, wherein a collecting line loop is provided having opposite ends which are connected to the two subsea vapor pipelines and which collecting line loop has a central part located at a lower level than its opposite ends and wherein a second drain is provided for draining condensed vapor which has collected at said central part of the collecting line loop, wherein the first drain is configured for re-introducing the condensed vapor at a downstream location (for example a swivel of the buoy). Thus, condensed vapor drained at the collecting hose part is re-injected at such a downstream location from which it flows to the collecting loop, from which it again can be removed by the second drain, for example by pigging.

In one such an embodiment the first drain comprises an access port offering access to an interior of the floating vapor hose and wherein a connecting condensate line connects the access port with the downstream location.

It is noted that the concept of the invention also relates to systems in which any of the mentioned components (for example the hoses or pipelines) are provided in a larger number than described in this application.

BRIEF DESCRIPTION OF THE DRAWINGS

Hereinafter aspects of the invention will be elucidated while referring to the drawings, in which.

DETAILED DESCRIPTION

Figure 1:
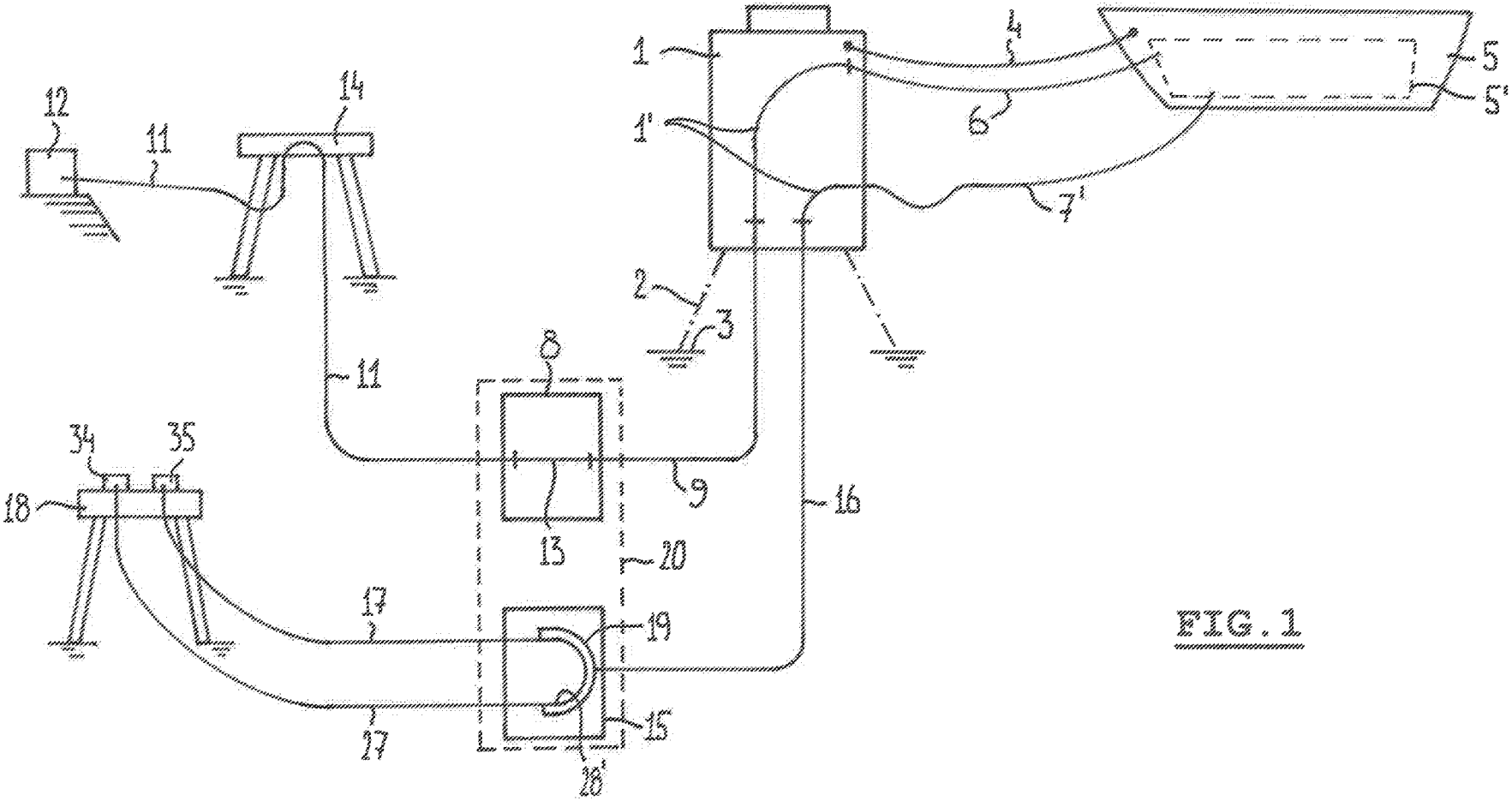
FIG. 1 shows a schematic representation of a system for transferring crude oil from an onshore location to an offshore vessel providing a vapor return.

In FIG. 1 a schematic representation is shown of a system for transferring crude oil from an onshore location to an offshore vessel providing a vapor return. It is noted that, although the following description of such a system and its details refers to the transfer of crude oil, the system according to the present invention also could be used for transferring other substances, such as for example gas or liquefied gas without departing from the scope of the invention. Further it is noted that the use of 'subsea' with connection to types of hoses does not exclude the possibility that part(s) of such hoses are located at or above sea level.

Firstly, the system comprises a buoy 1 with buoy piping 1', which buoy by means of mooring lines 2 may be moored to the seabed 3. Provisions may be made that the buoy, or part thereof, may weathervane. The buoy 1 carries a hawser 4 which can be picked up by an arriving vessel 5 (such as a crude carrier/oil tanker) to be attached (for example) to the bow of the vessel 5 for mooring the vessel to the buoy 1. Between the buoy 1 and the vessel 5 a floating oil hose 6 extends having a first end supported by the buoy 1 and an opposite second end configured to be connected to the vessel 5 (for example to specific manifolds, ports or valves offering access to a cargo tank 5' of the vessel). The manner in which such a connection can be established may vary and is not part of the invention. After connection the crude oil (or other substance) may be pumped into the cargo tank 5' of the vessel 5 through the floating oil hose 6.

Figure 2:
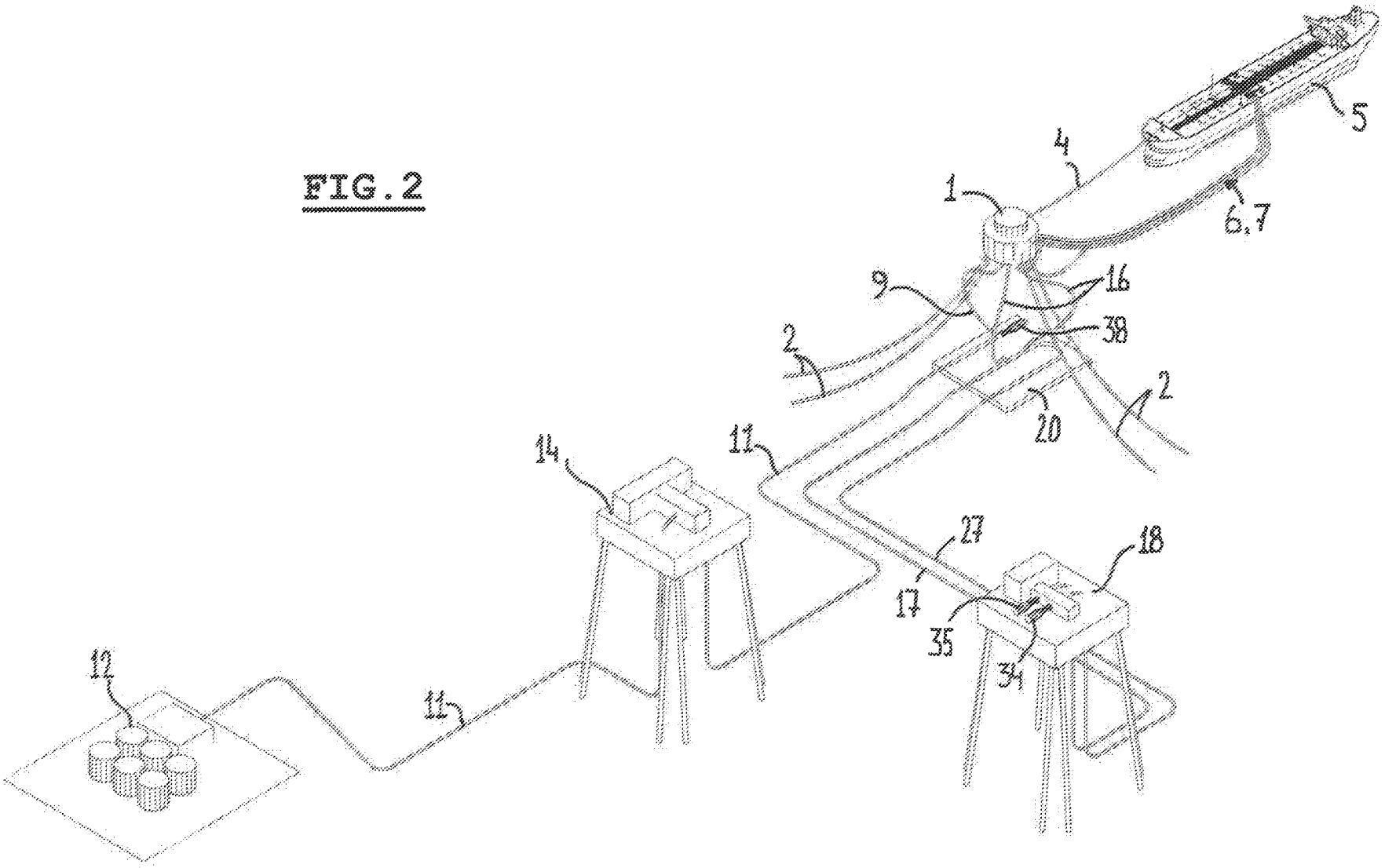
FIG. 2 shows a schematic perspective illustration of another embodiment of the system.

Further at least one (as illustrated in FIG. 2) floating vapor hose 7 is provided which likewise extends between the buoy 1 and the cargo tank 5' of the vessel 5 and which has a first end supported by the buoy 1 and an opposite second end configured to be connected to the vessel. After connection, the floating vapor hose 7 communicates with the top of the cargo tank 5' (specifically with vent holes thereof not represented here) and is capable of discharging vapor (typically a gas with low oxygen content and water vapor generated by the tanker inert gas system, for example (a mixture of) nitrogen, CO, $CO_2$, some $O_2$ and some methane or other volatile hydrocarbons or water vapor) which is pushed out of the cargo tank when the crude oil enters the latter.

The system further comprises a first subsea pipeline end manifold (hereafter called second PLEM) 8 which generally will be located on the seabed 3. A subsea oil hose 9 extends between said second PLEM 8 and the buoy 1 and has a first end supported by the second PLEM 8 and an opposite second end supported by the buoy 1 which, directly or indirectly (for example through a part of the buoy piping 1'), is connected to the (first end of the) floating oil hose 6. The buoy piping 1' may comprise or may cooperate with additional components of the buoy, such as, for example, manifolds or swivels (as is known per se).

A subsea oil pipeline 11 is provided which extends between the second PLEM 8 and on onshore oil supply 12 and has a first end configured to be connected to said onshore oil supply 12 (or any other feature for supplying oil, such as, for example, a pumping unit) and a second end supported by the second PLEM 8 and, directly or indirectly, connected to the (first end of the) subsea oil hose 9. Again, such a connection preferably will occur indirectly, for example through piping 13 which is part of the second PLEM 8 and which may comprise additional components, such as for example a manifold (not represented).

The subsea oil pipeline 11 may be routed along additional members, such as for example a pumping platform 14. For understanding the present invention the features and function of such additional members are not relevant and thus will not be elucidated further here.

As a further component the system comprises another subsea pipe-line end manifold (hereafter called first PLEM) 15 which also generally will be located on the seabed 3. A subsea vapor hose 16 is provided having a first end supported by the first PLEM 15 and an opposite second end supported by the buoy 1 and, directly or indirectly, connected to the (first end of the) floating vapor hose 7. Details of this connection will follow below.

Further two subsea vapor pipelines 17 and 27 are provided each having a first end configured to be connected to a vapor processing facility or platform 18 (the details of which are not relevant for understanding the present invention) and a second end supported by the first PLEM 15 and, directly or indirectly, connected to the (first end of the) subsea vapor hose 16. As will appear below, said convection preferably will be indirect through piping 19 which is part of the first PLEM 15.

It is possible that the first PLEM 15 and second PLEM 8 are combined into a single PLEM (indicated schematically at 20).

It also is conceivable that the platforms 14 and 18 are combined into a single platform.

The system further comprises means for the removal of condensed vapor from at least one of the floating vapor hose 7, buoy piping 1', subsea vapor hose 16 and subsea vapor pipelines 17 and 27. Embodiments of such means will be described below while referring to FIGS. 3-5.

Referring to FIG. 2, an embodiment of the system is illustrated in a schematic perspective view. Among others it shows the buoy 1 and the vessel 5 moored to the buoy through the hawser 4. Further the multiple floating oil hoses 6 and floating vapor hose 7 are assembled to a bundle.

A combined PLEM 20 is illustrated. Further one can see the subsea oil hoses 9 connecting (via the PLEM) to the subsea oil pipeline 11 which (via platform 14) is connected to the onshore oil supply 12.

FIG. 2 further shows two subsea vapor hoses 16 which, through the PLEM 20, are connected to the subsea vapor pipelines 17,27 which lead to the vapor processing facility 18.

Some components of the system, while being illustrated as a single component, also could be provided in larger numbers (such as illustrated in FIG. 2 for the subsea vapor hoses 16). For example multiple floating oil hoses 6, floating vapor hoses 7, subsea oil hoses 9 or subsea oil pipelines 11 may be provided too. The use of more than one buoy 1 is another option (for example for use with more vessels 5 simultaneously). The specific configuration of the system will depend from the relevant circumstances, but the basic design will be as illustrated in, or can easily be derived from FIG. 1.

Figure 3:
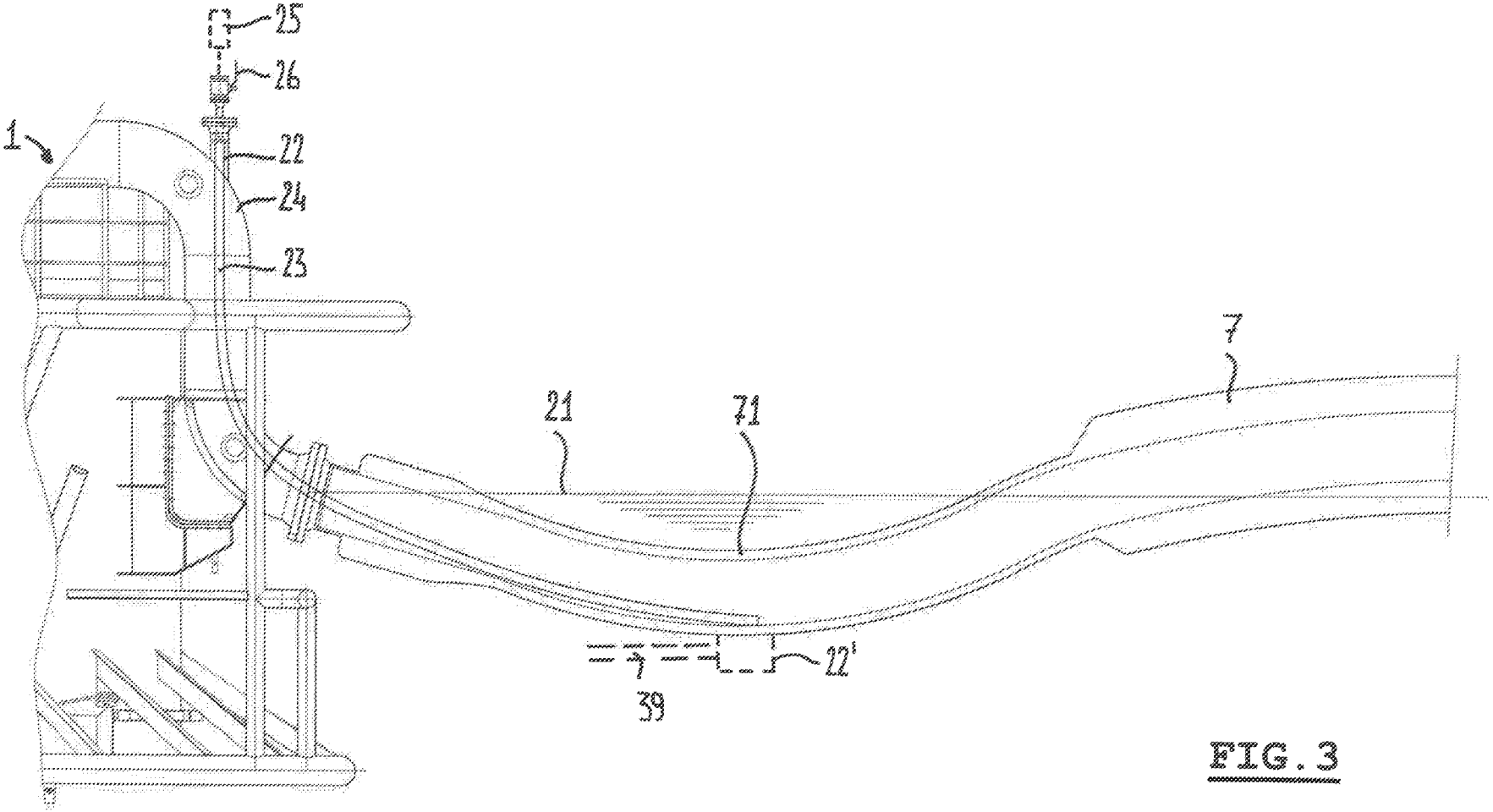
FIG. 3 shows a partial side elevational view of a buoy with connecting floating vapor hose.

Next, reference is made to FIG. 3 which illustrates a partial side elevational view of a buoy 1. The buoy 1 is provided with a connecting vapor line 24 which forms part of the buoy piping 1' having a first end connected to the (second end of the) subsea vapor hose 16 (not visible in this figure) and a second end connected to the (first end of the) floating vapor hose 7.

The floating vapor hose 7 in the region of its first end defines a collecting hose part 71 located at a lower level than opposite adjoining parts of the floating vapor hose 7 (for example in FIG. 2 one can see that the collecting hose part 71 for its greater part is located below sea level 21, whereas the other, adjoining parts of the floating vapor hose 7 at least partially are positioned at or above sea level 21). As a result condensed vapor will collect in said collecting hose part 71.

A drain is provided for draining condensed vapor which has collected at said collecting hose part 71. In the embodiment illustrated in FIG. 2 said drain comprises an access port 22 offering access to an interior of the floating vapor hose 7 and a draining tube 23 connected to the access port and extending therefrom into the floating vapor hose and ending at said collecting hose part 71. It is noted that in the illustrated embodiment the access port 22 is positioned at the connecting vapor line 24 and offers access to the interior of the floating vapor hose 7 (specifically the collecting hose part 71 thereof) indirectly through the connecting vapor line 24. In another embodiment (shown in phantom lines in FIG. 3 at 22') it is conceivable that the access port would be positioned directly in or at the floating vapor hose 7 (for example at collecting hose part 71) and then could be connected to an external draining tube 39. Such a draining tube 39 (but also the draining tube 23) also may be connected to a downstream location (for example a swivel of the buoy 1) through a condensate line (which, for example, may be defined by the external tube 39) for at that location re-introducing the condensed vapor which than flows towards a collecting loop to be described below.

The draining tube 23 may have a fixed position but it is also possible that it is configured to be removed from the floating vapor hose 7 (and/or connecting vapor line 24) when not used for removing condensed vapor from the collecting hose part 71 (for example for providing an unobstructed flow of the vapor).

A suction generator (indicated schematically at 25), such as a suction pump, may be provided configured to be connected to the draining tube 23 for actively draining condensed vapor from the collecting hose part 71 (preferably between tanker loadings). Further in the illustrated embodiment the access port 22 is provided with a manually operable closure member 26, such that the access port 22 is configured to be converted between an open and a closed position.

Figure 4:
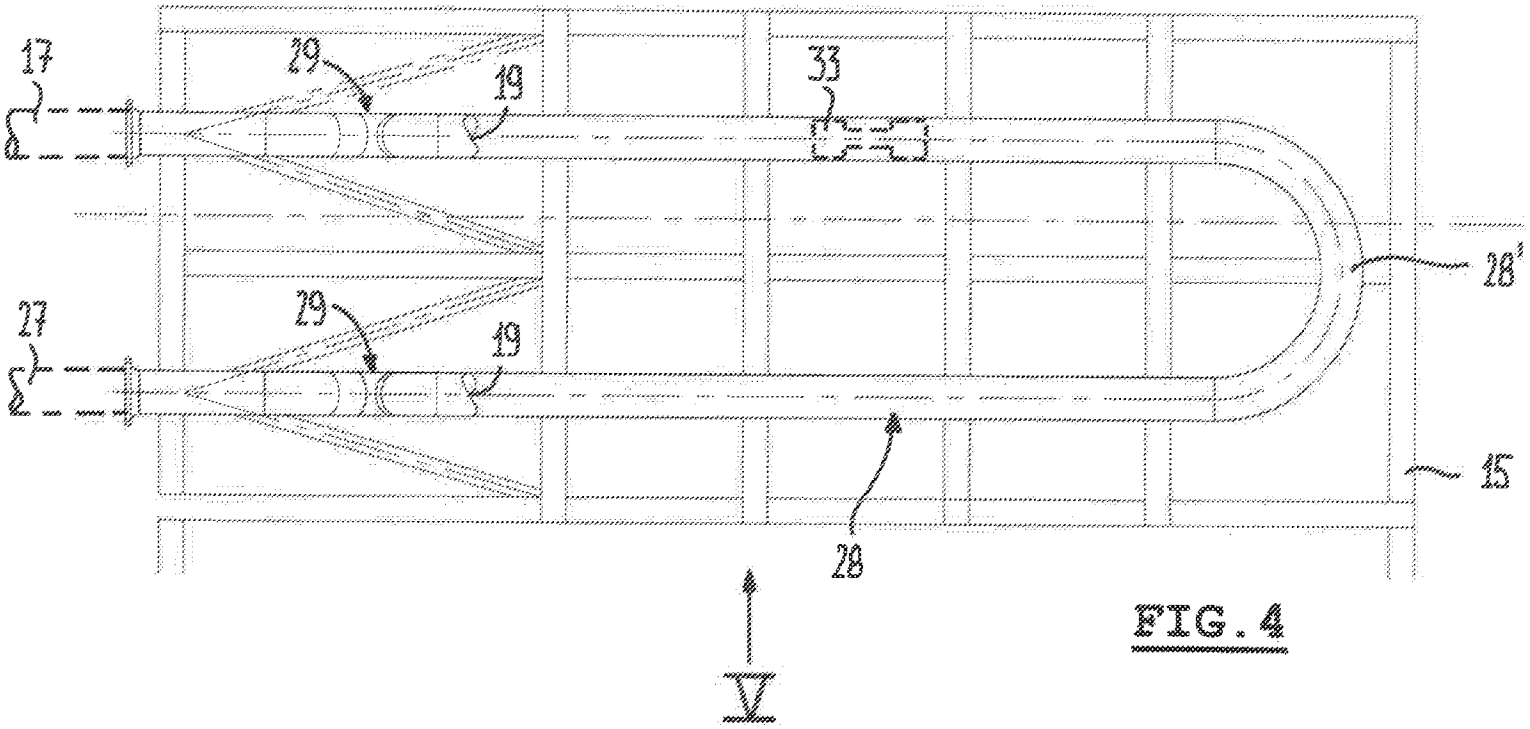
FIG. 4 illustrates, in part, a top plan view of a PLEM.
Figure 5:
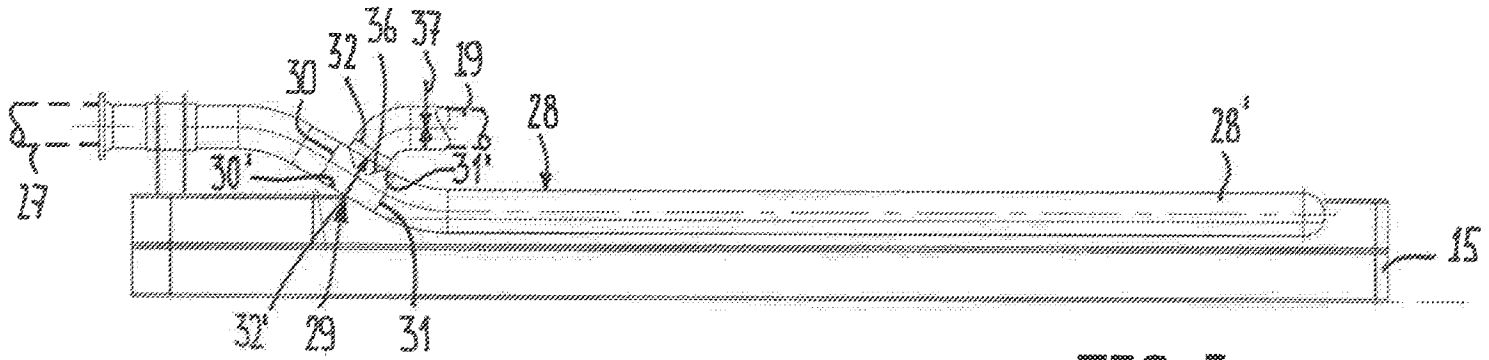
FIG. 5 is a side elevational view of the PLEM according to V in FIG. 4.

Next, another aspect of the invention will be described while referring to FIGS. 4 and 5 which illustrate a top plan view and side elevational view, respectively, of the first PLEM 15 according to FIG. 1. In FIG. 4 one can see the two subsea vapor pipelines 17 and 27 of which the second end is supported by the first PLEM 15. A collecting line loop 28 (which is located at and supported by the first PLEM 15) is provided having opposite ends which are connected to the respective second ends of the two subsea vapor pipelines 17 and 27. This collecting line loop 28 has a central part 28' located at a lower level than its opposite ends.

The first PLEM 15 further is provided with two vapor line T-connectors 29 for connecting the collecting line loop 28 (and thus the two subsea vapor pipelines 17 and 27) to the subsea vapor hose 16. This occurs indirectly through the piping 19 (also represented in FIG. 1). Each T-connector 29 comprises first and second ports 30, 31 (best seen in FIG. 5) located in line with each other, of which the first ports 30 respectively are, indirectly, connected to the (second ends of the) two subsea vapor pipelines 17 and 27 and of which the second ports 31 respectively are connected to the opposite ends of the collecting line loop 28. Each vapor line T-connector 29 further comprises a third port 32 at an angle with the first and second ports, wherein each third port 32 is connected to the piping 19 (as indicated schematically in FIG. 5) which leads to the (first end of the) subsea vapor hose or hoses 16.

Vapor arriving through the subsea vapor hose 16 and piping 19 enters the T-connectors through ports 32 and then flows through ports 30 towards the two subsea vapor pipelines 17 and 27. At the corner between the ports 32 and 30 condensed vapor will be directed through port 31 towards the central, lower, part 28' of the collecting line loop 28 and will remain there until removed. For an effective operation of the collecting line loop 28 it is preferred that the central part 28' of the collecting line loop 28 defines the lowermost part of the assembly of subsea vapor hoses and pipelines and collecting line loop. The path followed by the subsea vapor hose(s) and pipelines preferably should be such that there are no local depressions in which condensed vapor could be trapped. For example, the subsea vapor hose 16 (but also other hoses) could have a so called "Chinese lantern configuration" (as illustrated in FIG. 2).

For the removal (draining) of the condensed vapor from the collecting line loop 28 (specifically its central part 28') a drain is provided for draining condensed vapor which has collected at said central part of the collecting line loop. In one embodiment the drain comprises a pigging system comprising a pig (illustrated schematically at 33 in FIG. 4) which is movable through the subsea vapor pipelines 17 and 27 and through the collecting line loop 28 for removing condensed vapor which has collected at the central part 28' of the collecting line loop. In FIG. 1 schematically a pig launching station (or pig launcher) 34 for introducing the pig 33 in the respective vapor pipeline 17 and a pig receiving station (or pig catcher) 35 for removing the pig 33 from the respective vapor pipeline 27 are illustrated. The positions and directions of pigging may vary.

In FIG. 2 a similar station 38 has been illustrated for the introduction/removal of a pig (not illustrated) for pigging the subsea oil pipeline 11.

The first and second ports 30, 31 of the T-connectors define circumferential inner surfaces 30' and 31' and the third port 32 defines a passage opening 32' which is provided with bars 36 defining an inner guiding surface for the pig 33 contiguous with said inner surfaces 30' and 31' for providing a smooth transition of the pig 33 along the T-connectors 29.

For allowing to interrupt the flow of vapor through the two subsea vapor pipelines 17 and 27 during a pigging operation (preferably between tanker loadings) the third ports 32 or the piping 19 connecting thereto are configured to be closed by closure members, such as valves 37.

The invention is not limited to the embodiments described which may be varied widely within the scope of the invention as defined by the appending claims.

What is claimed is:

1. A system for transferring crude oil from an onshore location to an offshore vessel comprising:

a buoy provided with buoy piping;

at least one floating oil hose having a first end supported by the buoy and an opposite second end configured to be connected to the vessel;

at least one floating vapor hose having a first end connected to the buoy piping and an opposite second end configured to be connected to the vessel;

at least one subsea pipe-line end manifold (PLEM);

at least one subsea oil hose having a first end supported by the PLEM and an opposite end connected to the buoy piping;

at least one subsea oil pipeline having a first end configured to be connected to an onshore oil supply and a second end supported by the PLEM and, directly or indirectly, connected to the first end of the at least one subsea oil hose;

at least one subsea vapor hose having a first end supported by the PLEM and an opposite second end connected to the buoy piping;

at least one subsea vapor pipeline having a first end configured to be connected to a vapor processing facility and a second end supported by the PLEM and, directly or indirectly, connected to the first end of the at least one subsea vapor hose;

wherein the system further comprises a drain configured to remove condensed vapor from at least one of the floating vapor hose, buoy piping, subsea vapor hose and subsea vapor pipeline.

2. The system according to claim 1 and further provided with a second subsea pipe-line end manifold (second PLEM), wherein the system further comprises a subsea oil hose having a first end supported by the second PLEM and an opposite second end supported by the buoy and, directly or indirectly, connected to the first end of the floating oil hose, wherein the subsea oil pipeline comprises a first end configured to be connected to the onshore oil supply and a second end supported by the second PLEM and, directly or indirectly, connected to the first end of the subsea oil hose.

3. The system according to claim 2, wherein the PLEM and the second PLEM are integrated into a single combined PLEM.

4. The system according to claim 1, wherein the floating vapor hose in the region of its first end defines a collecting hose part located at a lower level than opposite adjoining parts of the floating vapor hose and wherein a first drain is provided for draining condensed vapor which has collected at said collecting hose part, and further provided with two subsea vapor pipelines having a first end configured to be connected to the vapor processing facility and a second end supported by the PLEM and, directly or indirectly, connected to the first end of the at least one subsea vapor hose, wherein a collecting line loop is provided having opposite ends which are connected to the two subsea vapor pipelines and which collecting line loop has a central part located at a lower level than its opposite ends and wherein a second drain is provided for draining condensed vapor which has collected at said central part of the collecting line loop, wherein the first drain is configured to reintroduce the condensed vapor at a downstream location.

5. The system according to claim 4, wherein the first drain comprises an access port offering access to an interior of the floating vapor hose and wherein an connecting condensate line connects the access port with the downstream location.

6. The system according to claim 1, and provided with two subsea vapor pipelines each having a first end configured to be connected to the vapor processing facility and a second end supported by the PLEM and, directly or indirectly, connected to the first end of the at least one subsea vapor hose, wherein a collecting line loop is provided having opposite ends which are connected to respective ones of the two subsea vapor pipelines and which collecting line loop has a central part located at a lower level than its opposite ends and wherein the drain is configured to remove condensed vapor which has collected at said central part of the collecting line loop.

7. The system according to claim 6, wherein the central part of the collecting line loop defines a lowermost part of the assembly of subsea vapor hose, subsea vapor pipelines and collecting line loop.

8. The system according to claim 6, wherein the collecting line loop is located at and is supported by the PLEM.

9. The system according to claim 8, wherein the PLEM is provided with two vapor line T-connectors each comprising first and second ports located in line with each other, of which the first ports respectively are connected to the second ends of the subsea vapor pipelines and of which the second ports respectively are connected to the opposite ends of the collecting line loop, and wherein each vapor line T-connector further comprises a third port at an angle with the first and second ports, wherein each third port is connected to the first end of the at least one subsea vapor hose.

10. The system according to claim 9, wherein the third ports or the subsea vapor hose(s) connecting thereto are configured to be closed by closure members.

11. The system according to claim 9, and further comprising a pigging system comprising a pig which is movable through the subsea vapor pipelines and through the collecting line loop for removing condensed vapor which has collected at the central part of the collecting line loop.

12. The system according to claim 11, wherein the first and second ports define a circumferential inner surface and wherein the third port has an opening which is provided with bars defining an inner guiding surface for the pig contiguous with said circumferential inner surface.

13. The system according to claim 1, wherein the floating vapor hose in the region of its first end defines a collecting hose part located at a lower level than opposite adjoining parts of the floating vapor hose and wherein the drain is configured to remove condensed vapor which has collected at said collecting hose part.

14. The system according to claim 13, wherein the drain comprises an access port offering access to an interior of the floating vapor hose.

15. The system according to claim 14, wherein the access port is provided in the buoy piping.

16. The system according to claim 14, wherein the access port is provided at the collecting hose part and wherein an external draining tube connects to the access port.

17. The system according to claim 14, wherein the access port is configured to be converted between an open and a closed position.

18. The system according to claim 17, wherein the access port is provided with a manually operable closure member.

19. The system according to claim 14, wherein a draining tube is provided extending from the access port into the floating vapor hose and ending at said collecting hose part.

20. The system according to claim 19, wherein the draining tube is configured to be removed from the floating vapor hose.

21. The system according to claim 19 and further comprising a suction generator configured to be connected to the draining tube for actively draining condensed vapor from the collecting hose part.

* * * * *